US007764299B2

(12) United States Patent
VanDemark

(10) Patent No.: US 7,764,299 B2
(45) Date of Patent: Jul. 27, 2010

(54) DIRECT THERMAL AND INKJET DUAL-SIDED PRINTING

(75) Inventor: Michael J. VanDemark, Springboro, OH (US)

(73) Assignee: NCR Corporation, Duluth, GA (US)

( * ) Notice: Subject to any disclaimer, the term of this patent is extended or adjusted under 35 U.S.C. 154(b) by 435 days.

(21) Appl. No.: 11/701,627

(22) Filed: Feb. 2, 2007

(65) Prior Publication Data

US 2007/0211134 A1 Sep. 13, 2007

Related U.S. Application Data

(60) Provisional application No. 60/779,781, filed on Mar. 7, 2006, provisional application No. 60/779,782, filed on Mar. 7, 2006.

(51) Int. Cl.
*B41J 2/32* (2006.01)

(52) U.S. Cl. ..... 347/171

(58) Field of Classification Search ..... 347/171, 347/172, 174, 176, 2, 107; 399/2, 3, 401
See application file for complete search history.

(56) References Cited

U.S. PATENT DOCUMENTS

| | | | |
|---|---|---|---|
| 3,947,854 | A | 3/1976 | Hansen et al. |
| 4,167,392 | A | 9/1979 | Defago |
| RE30,116 | E | 10/1979 | Maalouf |
| 4,309,255 | A | 1/1982 | Gendler et al. |
| 4,507,669 | A | 3/1985 | Sakamoto et al. |
| 4,631,596 | A | 12/1986 | Yaguchi |
| 4,708,500 | A | 11/1987 | Bangs et al. |
| 4,956,251 | A | 9/1990 | Washizu et al. |
| 4,965,166 | A | 10/1990 | Hosoi et al. |
| 4,987,118 | A | 1/1991 | Murata et al. |
| 5,055,373 | A | 10/1991 | Saeki et al. |
| 5,101,222 | A | 3/1992 | Hakkaku |
| 5,132,704 | A | 7/1992 | Nakagawa |
| 5,196,297 | A | 3/1993 | Dombrowski, Jr. |
| 5,214,750 | A | 5/1993 | Minowa et al. |
| 5,266,550 | A | 11/1993 | Asajima et al. |
| 5,272,127 | A | 12/1993 | Mandoh et al. |

(Continued)

FOREIGN PATENT DOCUMENTS

| | | |
|---|---|---|
| EP | 0947340 | 10/1999 |

(Continued)

OTHER PUBLICATIONS

JP Abstract, vol. 007,No. 063 (M-200), Mar. 16, 1983 & JP 57-208298 A (Ricoh KK), Dec. 21, 1982.

(Continued)

*Primary Examiner*—K. Feggins
(74) *Attorney, Agent, or Firm*—Schwegman, Lundberg & Woessner; Charles Q. Maney

(57) ABSTRACT

In one embodiment there is provided a dual-sided printer including a direct thermal print head positioned proximate to a first platen and an inkjet print head positioned proximate to a second platen. The direct thermal print head is in a substantially opposed relation to the second platen and the inkjet print head is in a substantially opposed relation to the first platen to facilitate thermal printing on a first side of installed media and inkjet printing on a second side of the installed media.

5 Claims, 1 Drawing Sheet

U.S. PATENT DOCUMENTS

| | | | |
|---|---|---|---|
| 5,284,816 | A | 2/1994 | Stephenson |
| 5,319,392 | A | 6/1994 | Durst et al. |
| 5,366,952 | A | 11/1994 | Granquist |
| 5,398,305 | A | 3/1995 | Yawata et al. |
| 5,428,714 | A | 6/1995 | Yawata et al. |
| 5,437,004 | A | 7/1995 | Miyasaka et al. |
| 5,476,698 | A | 12/1995 | Denny |
| 5,555,349 | A | 9/1996 | Miyasaka et al. |
| 5,584,590 | A | 12/1996 | Ito et al. |
| 5,594,653 | A | 1/1997 | Akiyama et al. |
| 5,629,259 | A | 5/1997 | Akada et al. |
| 5,639,169 | A | 6/1997 | Aruga |
| 5,667,303 | A | 9/1997 | Arens et al. |
| 5,677,722 | A | 10/1997 | Park |
| 5,686,159 | A | 11/1997 | Langan |
| 5,688,057 | A | 11/1997 | Wright et al. |
| 5,692,110 | A | 11/1997 | Miyasaka et al. |
| 5,707,925 | A | 1/1998 | Akada et al. |
| 5,710,094 | A | 1/1998 | Minami et al. |
| 5,755,521 | A | 5/1998 | Ito et al. |
| 5,756,188 | A | 5/1998 | Reiter et al. |
| 5,763,356 | A | 6/1998 | Ueno et al. |
| 5,781,823 | A | 7/1998 | Isobe et al. |
| 5,789,340 | A | 8/1998 | Brust et al. |
| 5,792,725 | A | 8/1998 | Simpson et al. |
| 5,794,530 | A | 8/1998 | Dobashi et al. |
| 5,800,081 | A | 9/1998 | Teradaira et al. |
| 5,815,191 | A | 9/1998 | Michielsen et al. |
| 5,846,900 | A | 12/1998 | Reiter et al. |
| 5,876,836 | A | 3/1999 | Imamura et al. |
| 5,883,043 | A | 3/1999 | Halbrook, Jr. et al. |
| 5,886,725 | A | 3/1999 | Miyadera et al. |
| 5,918,910 | A | 7/1999 | Stillwagon et al. |
| 5,964,541 | A | 10/1999 | Murison et al. |
| 5,980,128 | A | 11/1999 | Verlinden et al. |
| 6,000,726 | A | 12/1999 | Campbell |
| 6,000,867 | A | 12/1999 | Yoshii et al. |
| 6,095,414 | A | 8/2000 | Long et al. |
| 6,130,185 | A | 10/2000 | Narita et al. |
| 6,150,067 | A | 11/2000 | Koike et al. |
| 6,151,037 | A | 11/2000 | Kaufman et al. |
| 6,203,131 | B1 | 3/2001 | Wiklof |
| 6,210,517 | B1 | 4/2001 | Eadara et al. |
| 6,210,777 | B1 | 4/2001 | Vermeulen et al. |
| 6,350,072 | B1 | 2/2002 | Nunes et al. |
| 6,388,692 | B1 | 5/2002 | Iwata et al. |
| 6,523,951 | B2 | 2/2003 | Takeya et al. |
| 6,524,000 | B1 | 2/2003 | Roth |
| 6,543,808 | B1 | 4/2003 | Mitchell, Jr. et al. |
| 6,544,925 | B1 | 4/2003 | Prusik et al. |
| 6,562,755 | B1 | 5/2003 | Halbrook, Jr. et al. |
| 6,705,786 | B2 | 3/2004 | Trovinger |
| 6,737,137 | B2 | 5/2004 | Franko, Sr. et al. |
| 6,759,366 | B2 | 7/2004 | Beckerdite et al. |
| 6,784,906 | B2 | 8/2004 | Long et al. |
| 6,801,233 | B2 | 10/2004 | Bhatt et al. |
| 6,812,943 | B1 | 11/2004 | Day et al. |
| 6,906,735 | B2 | 6/2005 | Bhatt et al. |
| 6,982,737 | B2 | 3/2006 | Elko et al. |
| 7,192,904 | B2 | 3/2007 | Iwasaki et al. |
| 2003/0025779 | A1 | 2/2003 | Miyazaki |
| 2005/0164881 | A1 | 7/2005 | Kenney et al. |
| 2006/0072001 | A1 | 4/2006 | Klein |
| 2006/0289633 | A1 | 12/2006 | Moreland et al. |

FOREIGN PATENT DOCUMENTS

| | | |
|---|---|---|
| GB | 2 250 478 | 6/1992 |
| JP | 58051172 | 3/1983 |

OTHER PUBLICATIONS

JP Abstract, vol. 007, No. 081 (M-105), Apr. 5, 1983 & JP 58-008668 A (Shinko Denki KK), Jan. 18, 1983.

JP Abstract, vol. 015, No. 194 (M-1114), May 20, 1991 & JP 03-051149 A (Fujitsu General Ltd.), Mar. 5, 1991.

JP Abstract, vol. 2000, No. 24, May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.), Mar. 24, 1998.

JP Abstract, vol. 010, No. 151 (M-483), May 31, 1986 & JP 616-003765 A (Konishiroku Shashin Kogyo KK), Jan. 9, 1986.

JP Abstract, vol. 016, No. 041 (M-1206), Jan. 31, 1992 & JP 03-246091 A (Canon Inc.), Nov. 1, 1991.

Boca Systems Micro Plus 2S 2 Sided Printer product brochure which came to the attention of Applicant at a Chicago tradeshow during the summer of 2002.

PowerEcot R2412, APTI, 2Side Thermal Printer, Printing Technology & Solution, Translated by Applicant's Japanese Office in fall of 2007.

DIRECT THERMAL AND INKJET DUAL-SIDED PRINTING

CROSS REFERENCE TO RELATED APPLICATIONS

This application claims priority to U.S. Provisional Application No. 60/779,781 entitled "Two-Sided Thermal Printing" and filed on Mar. 7, 2006, U.S. Provisional Application No. 60/779,782 entitled "Dual-Sided Thermal Printer" and filed on Mar. 7, 2006, and U.S. patent application Ser. No. 11/644,262 entitled "Two-Sided Thermal Print Sensing" and filed Dec. 22, 2006; the disclosures of which are hereby incorporated by reference herein.

TECHNICAL FIELD

This disclosure relates to dual-sided printing. More particularly, this disclosure includes example embodiments directed to a direct thermal and inkjet dual-sided printer, dual-sided print media therefor and a method for printing a medium.

BACKGROUND

In many industries and applications there has been a shift away from printing documents including transaction documents (e.g., receipts, tickets, gift certificates, sweepstakes and the like) using bond paper, toward printing such documents using thermal paper or media in direct thermal printers. In direct thermal printing, a thermal print head selectively applies heat to thermal paper or other sheet media, which includes a substrate with one or more thermally sensitive coatings that change color when heat is applied, thereby providing "printing" on the coated substrate.

Direct thermal printing includes single-sided direct thermal printing for thermal printing of one side of the thermal media, and dual-sided direct thermal printing for thermal printing of both sides of the thermal media. In dual-sided direct thermal printing, a thermal printer is configured to allow concurrent printing on both sides of thermal media moving along a feed path through the thermal printer as further described in U.S. Pat. Nos. 6,784,906 and 6,759,366. In such a dual-sided direct thermal printer, a thermal print head is disposed on each side of two-sided thermal media comprising, inter alia, a substrate with a thermally sensitive coating on each of two opposing surfaces thereof. Each thermal print head faces an opposing platen across the thermal media from the respective print head. During printing, the opposing thermal print heads selectively apply heat to opposing sides of the two-sided thermal media, such that printing is provided on both sides thereof.

Single or dual-sided direct thermal printing is typically provided in one color (e.g., black, blue or red) on one or both imageable sides of respective single or dual-sided direct thermal media. For dual-sided direct thermal printing, a different color (e.g., black, red or blue) may be provided on each of two opposite media sides. However, printing of one side of a document in one color (e.g., black, blue or red), such as for printing of transaction detail, and simultaneously printing of the other side of the document in full color (e.g., CMYK), such as for printing of an advertisement or a coupon, which may be advantageous for point-of-sale applications, among others, is not readily available. Although single-sided direct thermal color printing has been developed and dual-sided direct thermal color printing is under development, they remain prohibitively expensive for many applications, especially in printing transaction documents containing multicolor images such as advertising at the point of sale. However, color inkjet printing is less expensive and has been employed in a variety of single-sided full color applications, such as desktop printing, for some time.

SUMMARY

In accordance with an embodiment, there is provided a dual-sided printer including: a thermal print head positioned proximate to a first platen; and an inkjet print head positioned proximate to a second platen, wherein the thermal print head is in a substantially opposed relation to the second platen and the inkjet print head is in a substantially opposed relation to the first platen.

In accordance with another embodiment, there is provided a dual-sided printer including: a thermal print head adapted to image a first side of a print medium; and an inkjet print head adapted to print a second side of the print medium.

In accordance with yet another embodiment there is provided a print medium including: a substrate including a first side and a second side; a direct thermal coating on the first side of the substrate; and an inkjet receptive coating on the second side of the substrate.

In still another embodiment, there is provided a method of imaging a print medium including a first side and a second side opposite the first side, the method including: receiving printing data; delineating the received printing data into at least a first portion and at least a second portion; activating a thermal print head to image the first portion of the delineated printing data on the first side of the print medium, and activating an inkjet print head to print the second portion of the delineated printing data on the second side of the print medium.

BRIEF DESCRIPTION OF THE DRAWINGS

Various features and attendant advantages of the example embodiments will be more fully appreciated as the same becomes better understood when considered in conjunction with the accompanying drawings, in which like reference characters designate the same or similar parts throughout the several views, and wherein.

DETAILED DESCRIPTION

Figure 1:
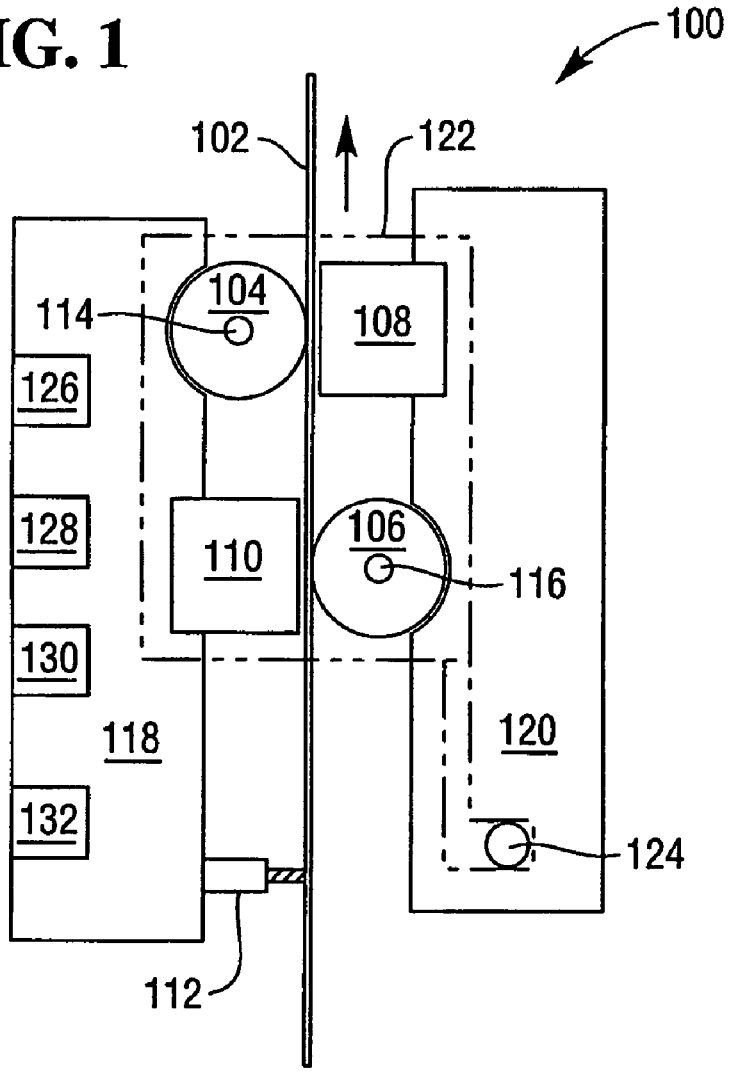
FIG. 1 illustrates a schematic of an example direct thermal and inkjet dual-sided printer for dual-sided direct thermal and inkjet printing.

FIG. 1 illustrates a schematic of an example direct thermal and inkjet dual-sided printer 100 for dual-sided printing of print media 102 such as that described below with reference to FIG. 2. A variety of print media 102 may be used to print various documents, such as receipts, tickets, gift certificates, sweepstakes, coupons, vouchers, as well as many other documents not enumerated herein. As will be described in greater detail below with reference to FIG. 2, print media 102 includes a thermally sensitive coating and, possibly, one or more base and/or top coat layers on at least a first side thereof. Likewise, print media 102 may further comprise an inkjet receptive coating and, possibly, one or more base and/or top coat layers, on a second side thereof to facilitate thermal and inkjet printing via the dual-sided printer 100. The thermal printing may be in a single color (e.g., black, blue or red), while the inkjet printing may be in any variety of colors including full or process color printing (e.g., cyan, magenta, yellow and black: CMYK).

Further with reference to FIG. 1, a dual-sided printer 100 may also include first and second support arms 118 and 120. Second support arm 120 may be journaled on an arm shaft 124 to permit the second support arm 120 to pivot or rotate in relation to the first support arm 118 to, for example, facilitate access to, and servicing of, the dual-sided printer 100. The support arms 118 and 120 may also be in a fixed relation to one another. The dual-sided printer 100 may further include platens 104 and 106 and opposing print heads 108 and 110 on opposite sides of the print media 102. More specifically, the first support arm 118 may include a first platen 104 and one or more direct thermal print heads 110, and the second support arm 120 may include a second platen 106 and one or more inkjet print heads 108. Alternatively, the first or second support arms 118 or 120 may include the first platen 104, the one or more direct thermal print heads 110, the second platen 106 and the one or more inkjet print heads 108. Additionally, the first support arm 118 may include the first platen 104 and one or more inkjet print heads 110, and the second support arm 120 may include a second platen 106 and one or more direct thermal print heads 108.

In further reference to FIG. 1, the one or more thermal 110 and inkjet 108 print heads will be discussed in the singular. However it is to be understood that more than one thermal and/or inkjet print heads are possible such as, for example, one inkjet print head for each of the colors (e.g., CMYK) in a full or process color application.

As illustrated in FIG. 1, the platens 104 and 106 are substantially cylindrical in shape, although other shapes, including flat surfaces such as plates, are possible. The first platen 104 may be journaled on a first shaft 114 and the second platen 106 may be journaled on a second shaft 116. The shafts 114 and 116 may be coupled to the support arms 118 and 120, respectively. Alternatively, shafts 114 and 116 may be coupled to a single support arm such as support arm 118 or 120.

With further reference to FIG. 1, it is noted that the print heads 108 and 110 are substantially in-line and face substantially opposed directions. As a result, the media feed path of the print media 102 may be substantially a straight line path given the substantially in-line orientation of the print heads 108 and 110. This configuration facilitates in-line feeding and exiting of the print media 102 to and from the dual-sided printer 100. The in-line feed path also facilitates automation of print media 102 replacement and feed, allowing the print media 102 to be automatically drawn from print head 110 and platen 106 through print head 108 and platen 104, or vice-versa, and accommodates thick or stiff media elements which may resist being bent or it may be otherwise undesirable to bend. Although the in-line orientation of print heads 108 and 110 is described, alternate orientations of print head 108 in respect to print head 110, including varied angle orientations (e.g., 45, 90, 135 and 180 degrees), are possible based on particular design requirements of the dual-sided printer 100, the print media 102 and/or the desired media feed path. It is also noted that the position of print head 108/platen 104 may be exchanged with that of print head 110/platen 106, or other possible variations as may be desired.

Still further with reference to FIG. 1, a dual-sided printer 100 may include a drive assembly 122. Drive assembly 122 may comprise one or more motors (not shown) for powering a system of gears, links, cams, and combinations thereof for operating the dual-sided printer 100. More specifically, platens 104 and 106 are rotatable via drive assembly 122 about shafts 114 and 116, respectively, for moving the print media 102 through the dual-sided printer 100. Additionally, a thermal print head 110 and an inkjet print head 108 may be stationary or fixed in the dual-sided printer 100 in relation to the print media 102 as it is advanced by the drive assembly 122 for printing by the print heads 108, 110. More specifically, the print heads 108 and 110 may be sufficiently wide (e.g., about as wide or wider than width of print media 102) to print the print media 102. Alternatively, one or both of the inkjet print head 108 and the direct thermal print head 110 may be narrower than the width of the print media 102 and may be stationary, or moveable laterally, e.g., perpendicularly to the movement of print media 102, via a lateral motion assembly (not shown) that may also be powered by the drive assembly 122 to print across the width of the print media 102. The direct thermal print head 110 may be any print head suitable for direct thermal imagining of a one side of the print media 102, such as those disclosed in U.S. Pat. Nos. 3,947,854, 4,708,500 and 5,964,541. The inkjet print head 108 may be any print head suitable for inkjet printing of the other side of print media 102, and may include one or more nozzles for depositing a plurality of colors on print media 102.

Additionally with reference to FIG. 1, the dual-sided printer 100 may further include one or more sensors 112 for determining various conditions to control operation of the printer 100, such as a media sensor to detect a paper low and/or a paper in/out condition, a media type sensor to detect a type of media (e.g., non-thermal, single-sided thermal, double-sided thermal, inkjet receptive, high and low gloss, etc.) installed in the printer 100, and a media size sensor to detect a size of media (e.g., width, length, thickness, shape, etc.) installed in the printer 100. Sensing of media type is described in U.S. patent application Ser. No. 11/644,262, which is hereby incorporated in its entirety by reference herein.

Yet further with reference to FIG. 1, the dual-sided printer 100 operates on print media 102, which may be supplied in the form of a continuous paper roll, a continuous fan-folded stack or cut sheet stock, and upon which features such as graphics or text, and combinations thereof, may be printed on one or both sides thereof via the respective print heads 108, 110, to provide a printed document having one side imaged via direct thermal printing in one color, and another side printed via inkjet printing in one or multiple colors. Although a variety of documents may be printed, documents such as receipts, tickets and coupons may be particularly well suited, in which transaction detail in one color may be imaged on one side by the direct thermal printed head 110 and advertising or other subject matter that can benefit from use of color may be printed in a variety of colors, including full color, on the other side by the inkjet print head 108. In some applications, such as tickets, it may be desirable to include transaction information (e.g., date, time, price, purchaser, payment means, origin, destination, event, and the like) on a thermally imaged side of print media 102, and a full color picture of a purchaser and/or designated attendee on an inkjet printed side. Where applied to receipts, such application may be used to minimize the risk of receipt fraud, tying the purchase of one or more items, and subsequent return thereof, to a particular person.

Further with reference to FIG. 1, dual-sided printing may be facilitated by, for example, the print media 102 including a thermal coating comprising a thermal imaging component on one side of the print media 102 and an inkjet receptive coating on the other side of the print media 102. The print media 102 may also include a sufficiently thermally resistant substrate to inhibit thermal printing on the one side of the print media 102 from affecting inkjet printing on the opposite side of the print media 102. The substrate may also be sufficiently ink resistant (e.g., hydrophobic, non-porous, etc.) to inhibit inkjet printing on the one side of the print media 102 from affecting thermal printing on the opposite side of the print media 102. The substrate may be a cellulosic or a polymer substrate sheet coated with a thermal coating having a heat sensitive dye on one side and an inkjet receptive coating on the other side.

With further reference to FIG. 1, the dual-sided printing of the print media 102 may be accomplished in a single pass process. Alternately, the dual-sided printing may be accomplished in a process where the media 102 may be printed by one or both of the print heads 108 and 110 when moving in a first direction, and then retracted for further printing by the one or both print heads 108 and 110 with the media moving in either the first or the second, retract direction. Once printing is completed, the print media 102 may be manually or automatically cut or detached via a cutoff device (not shown), where the print media 102 exits from the dual-sided printer 100, to form a document having, inter alia, single color thermal printing on one side and single or full color inkjet printing on the other side thereof.

Still with further reference to FIG. 1, the dual-printer 100 also includes control electronics for controlling the operation of the dual-sided printer 100. The control electronics may include a microprocessor or central processing unit (CPU) 126, and memory 128, such as one or more dynamic random access memory (DRAM) and/or non-volatile random access memory (NVRAM) print buffer memory elements. The control electronics may further include a communication controller 130 for communicating with one or more host or auxiliary systems, such as a point-of sale (POS) terminal or a computer, for input of data to and output of data from the dual-sided printer 100. The communication controller 130 may support universal serial bus (USB), Ethernet and/or wireless communications, among others. The data for printing would typically be supplied by the POS terminal or the computer communicating with the dual-sided printer 100 via the communication controller 130.

As further illustrated in FIG. 1, the printer 100 may further include a printing function switch 132, implemented in hardware or software, for controlling, inter alia, operation of one or more dual-sided printer modes or functions including operation of a first and a second print head 108, 110. Dual-sided printer functionality may be controlled using commands implemented with, for example, setup configuration settings in hardware or software, escape sequences, real-time printer commands, and the like. The printing function switch 132 may buffer received printing data in memory 128 and may further determine how the received or buffered printing data is to be delineated between a first and a second side of print media 102. For example, the printing function switch 132 may automatically designate received transaction detail to be imaged in a single color via thermal print head 110 on a first side of the print media 102, while designating received advertisement detail for printing in one or more colors, up to and including full color, via inkjet print head 108 on a second side of the print media 102.

In one embodiment, the printing function switch 132 may designate received transaction detail for printing on a first side of the media 102 by storing the received transaction detail in a first portion of the memory 128. Likewise, the printing function switch may designate received advertisement detail for printing in one or more colors, up to and including full color, on a second side of the media 102 by storing the received advertisement detail in a second portion of the memory 128. Data retrieved from the first memory portion may then be printed on the first side of the print media 102 while data retrieved from the second memory portion may be printed on the second side of the media 102. Such data may be retrieved and/or further processed for printing by the CPU 126.

In operation, advertisement detail data may be received contemporaneously with transaction detail data from a host terminal or computer such as a POS terminal. Alternatively, advertisement detail comprising one or more advertisements, coupons, vouchers, rebates and the like, may be received and stored in advance of the transaction detail, and selected for printing with particular transaction detail by the printing function switch 132. Such selection may be made based on, inter alia, the transaction detail including goods or services purchased, a time of day, a day of the week, a week, month, or season of the year of the transaction, a total transaction price, payment means (e.g., credit, debit, check, automatic funds transfer, etc.), identity of the purchaser, purchase history, a loyalty program, and the like. Alternately, such selection may be random according to one or more algorithms.

In one embodiment, with reference to FIG. 1, memory 128 of the dual-sided printer 100 may have a predefined print data storage area to store one or more blocks of predefined print data to be repetitively printed on one or both sides of the print media 102. The blocks of predefined print data may include, for example, one or more of a store or other location identifier, a logo, an advertisement, coupon information, legal information including warranties and disclaimers, and the like. Additional information not expressly enumerated may also be included in the blocks of predefined print data. The predefined print data may be printed along with received printing data provided by the POS terminal or computer on any one or both sides of print media 102. Such printing may be automatic, occurring every time without other intervention or control, and/or may be selectable and/or controllable by, for example, the printing function switch 132. Where multiple data blocks are stored in the predefined print data storage area, or received from the POS terminal via the communication controller 130, the blocks may be alternately selected for printing on one or both sides of the print media 102 by the printing function switch 132. In addition to being selected for printing as part of each print job, such predefined print data may be selected for printing based on, for example, received transaction detail or a random algorithm as described above.

In addition to the use of a printing function switch 132, the dual-sided printer 100 may support different mechanisms for delineating received print data for printing on the print media 102. For example, the CPU 126 may receive delineated data for printing by respective print heads 108 and 110 directly from the communication controller 130, and the CPU 126 may then control activation of the respective print heads 108 and 110 for printing the received print data on the respective sides of print media 102.

Figure 2:
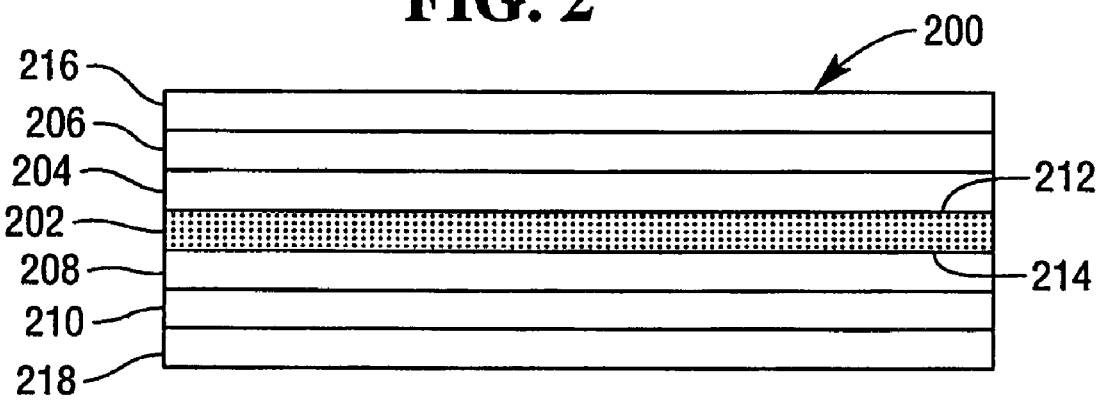
FIG. 2 illustrates a cross-section of an example combination direct thermal and inkjet print media for use in a printer in accordance with FIG. 1.

FIG. 2 illustrates a cross-section 200 of an example combination direct thermal and inkjet print media 102 for use in a printer 100 in accordance with FIG. 1. As depicted in cross-section 200, the print media 102 may include a substrate 202 having a first surface 212 and a second surface 214. The first surface 212 may further be coated with a first primer 204, and the second surface 214 may further be coated with a second primer 208. Additionally, the print media 102 may further comprise an inkjet receptive coating 206, such as one or more layers of ceramic particles arranged into a pattern of pores, and a thermal functional coating 210, such as one or more leuco dyes, developers and/or sensitizers. The substrate 202 may be generally opaque to inhibit direct thermal printing on one side of the print media 102 from being visible on the other side of the print media 102, as well as inhibiting inkjet color printing on one side of the print media 102 from being visible on the other side of the print media 102. The substrate 202 may further be sufficiently thermally resistant to inhibit thermal printing on the one side of the print media 102 from affecting inkjet printing on the opposite side of the print media 102. Still further, the substrate 202 may also be sufficiently ink resistant to inhibit inkjet printing on the one side of the print media 102 from affecting thermal printing on the opposite side of the print media 102.

Further with reference to FIG. 2, the first primer 204 may applied to the first surface 212 and the second primer 208 may be applied to the second surface 214 using any suitable process such as flooding and metering, followed by drying. Generally, flooding with an aqueous coating mixture and then metering off the excess accomplish the application of the primers 204 and 208 to the substrate 202. The inkjet receptive coating 206 and the thermal functional coating 210 may be applied, respectively, to the substrate 202 or the first and second primers 204 and 208 using any suitable process such as flooding and metering, followed by drying. Alternatively, spraying, dipping or gravure coating may be used instead of flooding and metering, with respect to applying the first and second primers 204 and 208, as well as the inkjet receptive coating 206 and the thermal functional coating 210. A top coating 216, 218, as well as additional coatings (not shown), may also be applied to the respective inkjet receptive coating 206 and/or the thermal functional coating 210 using any suitable process such as flooding and metering, followed by drying, or alternatively by spraying, dipping or gravure coating. The top and/or additional coatings may provide benefits in terms of image quality, permanence, and resistance to a wide range of detrimental or deleterious effects (e.g., scratching, water, ultraviolet light and the like), desired by various printing applications. It is noted that the first and second primers 204 and 208, and the first and second top coatings 216 and 218, may be omitted, with the print media 102 including just the inkjet receptive coating 206 and the thermal functional coatings 210 applied directly to the respective first and second surfaces 212 and 214 of the substrate 202 using any suitable process as described above.

Yet further with reference to FIG. 2, the substrate 202 may include a cellulosic material. Suitable cellulosic materials include non-woven pulp-based materials. Alternatively, the substrate 202 may include a polymeric material, such as polypropylene or polyethylene, which may be in the form of a film. The first and second primers 204 and 208 may be of any suitable material to facilitate the adherence of the inkjet receptive coating 206 and thermal functional coatings 210 to, respectively, the first and second surfaces 212 and 214 of the substrate 202. For example, the first and second primers 204 and 208 may be of a water-based mixture including mainly clay materials, which may be spread on the substrate 202 and then dried. The first and second primers 204 and 208 may be used to buffer the inkjet receptive coating 206 and thermal functional coating 210 from active residue in the substrate 202.

Still further with reference to FIG. 2, the inkjet receptive coating 206 may include one or more coats for printing one side of the print media 102 in full color, as described above in reference to FIG. 1. In addition, the coating 206 may provide advantages such as improved ink drying capabilities, as well as improved image stability. The thermal functional coating 210 may include any single color thermal imaging component for imaging a thermal side of print media 102 in a single color, as described above in reference to FIG. 1. The thermal imaging component may be a heat sensitive dye or dye precursor. In addition, the thermal imaging component may be mixed with appropriate binders, additives, solvents and reagents (e.g., activators) as desired to allow ease of coating when the thermal functional coating 210 is applied to the substrate 202 and proper functioning of the thermal functional coating 210 when imaged by dual-sided printer 100.

In operation of the dual-sided printer 100, and in accordance with FIGS. 1-2, dual-sided print media 102 may be unrolled from a print media roll, taken from a fan-folded print media stack, or obtained as cut sheet stock from a paper tray, and may be moved along a media feed path through print heads 110 and 108 for dual-sided inkjet/thermal printing, after which it may be outputted to the outside of the dual-sided printer 100.

In operation, the printer 100 may receive, via communication controller 130, delineated printing data (including color information for inkjet print head 108) for printing by the respective print heads 108 and 110. Such print data may be stored in a memory 128 of the printer or directly sent to the CPU 126 for processing and printing by the respective print heads 108 and 110 on respective sides of print media 102 in accordance with FIGS. 1-2. Alternately, in some embodiments, operation of the printer 100, including selection of data for, and/or enabling of printing by, one or both of the print heads 108 and 110, may be controlled by a printing function switch 132 as further described hereinabove. Such control may comprise delineating received and/or stored data for printing by respective print heads 108 and 110, including determining one or more colors for printing by the inkjet print head 108.

Additionally, in some embodiments, printer control may be limited based on one or more signals from one or more print sensors 112. Such sensors 112 may include (i) a paper quantity sensor for producing a signal indicative of a quantity of paper (e.g., full, low and/or out) installed in or associated with a printer 100, (ii) a print media type sensor for producing a signal indicative of a type of media (e.g., non-thermal, single-sided thermal, double-sided thermal, inkjet receptive, inkjet receptive thermal, and the like) installed in or associated with a printer 100, and/or (iii) a print media size sensor for producing a signal indicative of a size (e.g., length, width and/or thickness) of media installed in or associated with the printer 100. One or more signals from the one or more installed print sensors 112 may be used to control one or more functions or operations of the printer 100 such as enabling and/or disabling printing by one or more print heads 108 and 110, a location for printing on one or both sides of the media 102 by one or more print heads 108 and 110, a speed of printing, a quantity of ink dispersed by an inkjet print head 108, a quantity of heat applied by one or more thermal print heads 110, and the like.

When so enabled, and as further described hereinabove, the inkjet print head 108 may print first printing data in one or more colors, including full color, on one side of the print media 102 and the direct thermal print head 110 may image second printing data, which may be the same as or different from the first printing data, in a single color (e.g., black, blue or red) on the other side of the print media 102.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the description. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

What is claimed is:

1. A print medium comprising:

a substrate including a first side and a second side;

a direct thermal coating on the first side of the substrate;

an inkjet receptive coating on the second side of the substrate;

a first primer disposed between the substrate and the direct thermal coating on the first side; and a second primer disposed between the substrate and the inkjet receptive coating on the second side.

2. A print medium comprising:

a substrate including a first side and a second side;

a direct thermal coating on the first side of the substrate;

an inkjet receptive coating on the second side of the substrate; and a top coating disposed over the direct thermal coating.

3. A print medium comprising:

a substrate including a first side and a second side;

a direct thermal coating on the first side of the substrate; and an inkjet receptive coating on the second side of the substrate, wherein the substrate is generally opaque to inhibit thermal imaging on the first side from being visible on the second side and to inhibit inkjet printing on the second side from being visible on the first side.

4. A print medium comprising:

a substrate including a first side and a second side;

a direct thermal coating on the first side of the substrate; and an inkjet receptive coating on the second side of the substrate, wherein the substrate is sufficiently thermally resistant to inhibit thermal imaging on the first side from affecting inkjet printing on the second side.

5. A print medium comprising:

a substrate including a first side and a second side;

a direct thermal coating on the first side of the substrate; and an inkjet receptive coating on the second side of the substrate, wherein the substrate is sufficiently ink resistant to inhibit inkjet printing on the second side from affecting thermal imaging on the first side.

* * * * *